US005332873A

United States Patent [19]

Kullander et al.

[11] Patent Number: 5,332,873

[45] Date of Patent: Jul. 26, 1994

[54] MOTOR VEHICLE MUFFLER

[75] Inventors: Urban Kullander, Angered; Karl Bergquist, Harestad, both of Sweden

[73] Assignee: AB Volvo, Gothenburg, Sweden

[21] Appl. No.: 50,107

[22] PCT Filed: Nov. 5, 1991

[86] PCT No.: PCT/SE91/00745

§ 371 Date: Jul. 2, 1993

§ 102(e) Date: Jul. 2, 1993

[87] PCT Pub. No.: WO92/08881

PCT Pub. Date: May 29, 1992

[30] Foreign Application Priority Data

Nov. 9, 1990 [SE] Sweden ..... 9003571

[51] Int. Cl.[5] ..... F01N 7/18

[52] U.S. Cl. ..... 181/243; 181/252; 181/264; 181/282

[58] Field of Search ..... 181/243, 240, 248, 249, 181/252, 256, 257, 258, 264, 265, 269, 270, 281, 282

[56] References Cited

U.S. PATENT DOCUMENTS 4,132,286 1/1979 Hasui et al. ..... 181/265
4,700,806 10/1987 Harwood ..... 181/282
4,834,214 5/1989 Feuling ..... 181/249

FOREIGN PATENT DOCUMENTS 0337877 10/1989 European Pat. Off. .
0353761 2/1990 European Pat. Off. .
2071209 9/1981 United Kingdom .
2097857 11/1982 United Kingdom .

*Primary Examiner*—Michael L. Gellner
*Assistant Examiner*—Khanh Dang
*Attorney, Agent, or Firm*—Young & Thompson

[57] ABSTRACT

A motor vehicle muffler comprising a housing comprising two half shells, and an exhaust conduit having two ends. The conduit is disposed within the housing and is securely joined to the housing at its two ends. Filler material within the housing surrounds the exhaust conduit, the exhaust conduit being in contact only with the filler material between the two ends of the exhaust conduit. The housing has a length and a width and a depth, its length and width being greater than its depth, and at least one plate extends in the direction of the depth of the housing, between the half shells, and is securely joined to the half shells without touching the exhaust conduit. For this purpose, the plate has notches in which leg portions of the exhaust conduit are disposed in spaced relation to the plate. The half shells of the housing are joined to each other by a folded seam and are joined to the ends of the exhaust conduit by welded joints, and are also joined to the plate by welded joints.

4 Claims, 2 Drawing Sheets

MOTOR VEHICLE MUFFLER

The present invention relates to a motor vehicle muffler comprising an exhaust conduit extending, surrounded by filler material, inside a housing, said housing comprising two half shells.

In recent years, greater demands have been placed on motor vehicles, especially passenger cars, as regards aerodynamic design of the body and undercarriage. Among other things, this has meant that greater attention has been paid to eliminating protruding components with high air resistance on the underside of the vehicle. As a result of this development, present day motor vehicle mufflers tend to have a flat design. Furthermore, the available space for a muffler is usually limited, which means that the muffler must be adapted to said limited space in order to increase the effective volume.

Such flat mufflers are known, for example, by GB-A-2 097 857, DE-C2-3 238 638, and EP-A1-0 337 877. As is evident from these specifications, the known mufflers are of relatively complicated design with many different components. The assembly thereof will thus also encompass many steps, and is therefore time-consuming and expensive.

The present invention is intended to provide a flat muffler using a minimum of materials and with a simpler design than the previously known mufflers, which is easy to manufacture, permits uncomplicated and rapid assembly of the components in the muffler, and which only introduces a minimum of heat stress in the design.

This goal is achieved according to the invention with a muffler of the type described by way of introduction, which is characterized in that the two ends of the exhaust conduit are securely joined to the housing and that the exhaust conduit in the interior of the housing is only in contact with the filler material of the housing. Assembly of such a muffler involves, in addition to filling in the filler material, only placing the exhaust conduit in one of the half shells, whereafter the other half shell is placed thereon and is joined to the first half shell. The joint between the ends of the exhaust conduit and the housing can be effected either when the exhaust conduit is laid in one of the half shells or when the half shells are Joined to each other. Assembly of a muffler according to the invention thus involves few steps and can be done quickly and simply. By virtue of the fact that the exhaust conduit inside the housing only makes contact with the filler material, no heat stresses will be introduced in the interior of the housing.

In a preferred embodiment of the muffler according to the invention, in which the half shells have a length and width which is greater than their depths, there is at least one means extending vertically between the half shells without touching the exhaust conduit, said means being securely joined to the bottoms of the half shells. This essentially prevents the bottoms of the half shells, when the muffler is in use, from being caused to oscillate like a diaphragm and thus creating noise.

Preferred embodiments for such means are disclosed in the subclaims.

One preferred embodiment of a muffler according to the invention will now be described with reference to the accompanying drawings, of which:

Figure 3:
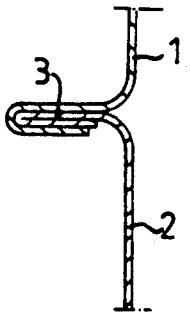
FIG. 3 shows a section along the lines III—III in FIG. 2, and FIGS. 4 and 5 show the lower half shell of the muffler in FIG. 1 in a view from the rear and a view from the side.

The muffler shown in the Figures comprises a housing made up of an upper half shell 1 and a lower half shell 2, which are joined to each other by means of a folded seam 3. The folded seam 3 is shown in detail in FIG. 3. Both the length and width of each of the half shells 1, 2 are preferably greater than twice the depth thereof.

An exhaust conduit or convoluted pipe 4 extends through the housing, and its ends 5, 6 are disposed at opposite longitudinal sides of the housing. The convoluted pipe 4 consists of two U-shaped pipe sections 7, 8 which are connected to form an S, the free legs of which are extended by inlet and outlet pipes 9, 10, the ends of which extends through openings 11, 12 in the longitudinal sides of the housing, said openings being achieved by cooperating semicircular recesses in the half shells 1, 2. The U-shaped pipe sections 7, 8 are in themselves made up of two semicircular pipes with outwardly projecting flanges, said pipe sections being welded to each other and to the inlet and outlet pipes 9, 10 to form the S-shaped convuluted pipe 4. Even though this design of the convoluted pipe 4 is to be preferred for manufacturing reasons, this design is not essential to the invention. Convoluted pipes made in any suitable manner can be used in a muffler according to the invention.

Figure 1:
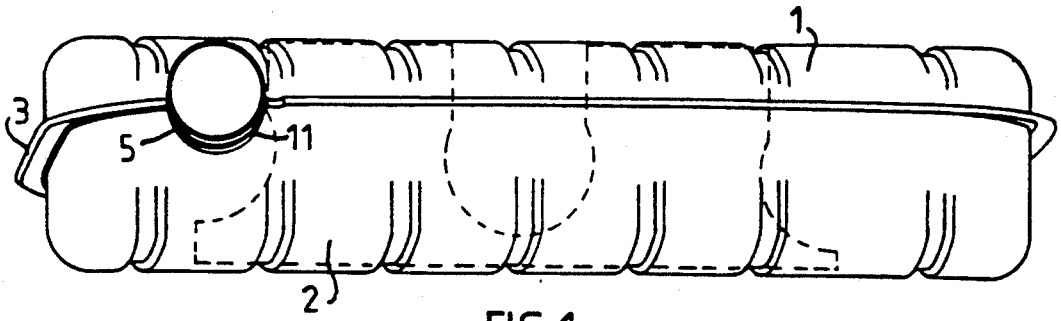
FIG. 1 shows a side view of a muffler according to the invention.
Figure 2:
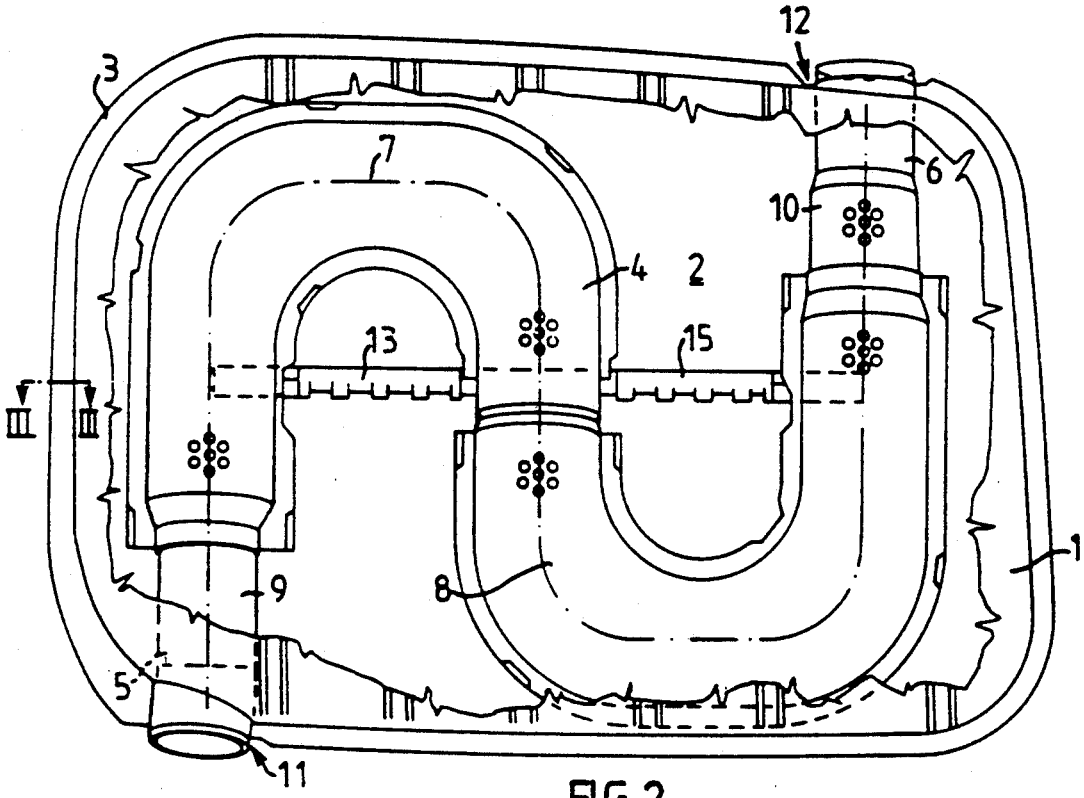
FIG. 2 shows a view from above of the muffler in FIG. 1 with a major portion of the upper half shell removed.

As is indicated in FIG. 2, the walls of the convoluted pipe 4 are perforated in the usual manner.

The muffler according to the invention in its embodiment shown in the Figures also comprises a plate 13, which interconnects the bottoms of the half shells 1, 2, and for this purpose has at its ends flanges 14, 15 (FIG. 5), which are welded to the bottom of the respective half shell. Interconnecting the bottoms of the half shells reduces the risk that the bottoms during operation of the muffler will begin to oscillate and thus create noise. This measure means that the oscillation amplitude of the bottoms of the half shells will be substantially smaller and this substantially decreases the sound level of the noise which can be created. In a test where the bottoms of the half shells were joined to each other with the aid of a number of welded pins, the noise due to oscillation of the bottoms was reduced by 12 db, which corresponds to a noise decrease of about 75%. An audible reduction of the outlet noise was also noticed during the test.

As is evident from said test, other elements, such as pins or the like can be used to interconnect the bottoms of the half shells, but for manufacturing reasons, especially the assembly om the components of the muffler, it is preferable to make the interconnection as a plate in one piece to facilitate assembly and to reduce the number of welds.

Figure 4:
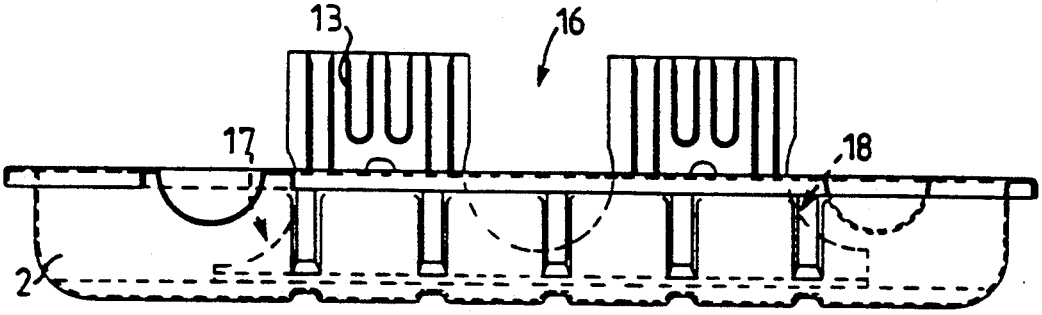

FIG. 4 shows the half shell 2 with welded on plate 13 from the rear. Even though it is not shown in the Figure, this plate 13 is preferably perforated and corrugated, the latter primarily to increase the total stiffness of the plate. Furthermore, the plate 13, as is best shown in FIG. 4, has a central slot or notch 16, and a notch 17 and 18, respectively, at either end. These notches are shaped so that the plate 13 when the muffler has been assembled will not touch any portion of the pipe 4. This feature that the pipe 4 makes no contact with the plate 13 thus prevents heat stresses from arising in the interior of the muffler housing when the convoluted pipe is heated by the hot exhaust from the vehicle engine during operation. Furthermore, the free suspension of the pipe inside the housing permits thermal expansion thereof without any substantial heat stresses arising at the joints of the inlet and outlet pipes 9, 10 to the housing.

The muffler described is assembled in the following manner.

Figure 5:
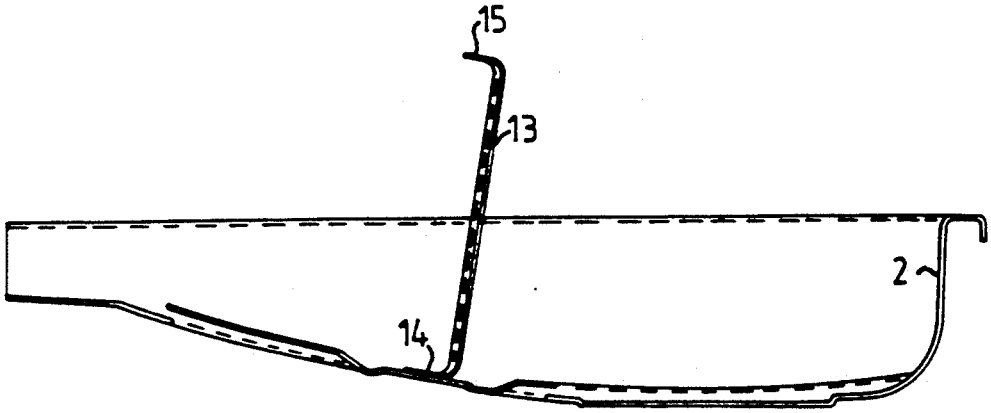

First the two half shells 1 and 2 are filled with filler material, for example glass-wool, the plate 13 prior to filling being welded to the bottom of the half shell 2, as shown in FIGS. 4 and 5. Thereafter, the convoluted pipe 4 is laid into the half shell 2 and is welded at its ends 5, 6 in corresponding semicircular notches in the longitudinal walls of the half shell 2. The half shell 1 is then laid on top of the half shell 2 and the flanges of the half shells are folded together to form the folded seam 3 (see FIG. 3). Finally, the plate 13 is welded to the bottom of half shell 1 and possibly the inlet and outlet pipes 9, 10 are welded to the notches of the half shell 1.

In one variation, all welding of the inlet and outlet pipes is done after the folded seam has been made between the half shells 1, 2, i.e. the welding of the plate 13 to the half shell 1 and the welding of the inlet and outlet pipes to the notches in the half shells 1, 2 is done in a single final welding step.

The invention thus provides a muffler of simple design, few components, said muffler per, hitting particularly simple and rapid assembly and in which very small heat stresses are produced.

The described embodiment of the muffler according to the invention can of course be modified within the scope of the inventive concept, especially as regards the shape and extent of the convoluted pipe 4 and the plate 13. The invention is thus only limited by the scope of the accompanying patent claims.

We claim:

1. A motor vehicle muffler comprising a housing comprising two half shells, an exhaust conduit having two ends, said conduit being disposed within said housing and securely joined to the housing at said two ends, filler material within the housing surrounding the exhaust conduit, the exhaust conduit being in contact only with the filler material between said two ends of the exhaust conduit, said housing having a length and a width and a depth, said length and width being greater than said depth, and at least one means extending in the direction of said depth between the half shells and securely joined to the half shells without touching the exhaust conduit.

2. A muffler as claimed in claim 1, wherein said exhaust conduit consists of U-shaped perforated pipe components joined in an S shape, said means extending between the half shells comprising a plate that has notches in which said leg portions are disposed in spaced relation to said plate.

3. A muffler as claimed in claim 2, wherein said plate is perforated.

4. A muffler as claimed in claim 1, wherein said half shells are joined to each other by a folded seam and are joined to said ends of the exhaust conduit by welded joints, said means comprising a plate and said half shells being joined to said plate by means of welded joints.

* * * * *